United States Patent [19]

Brown et al.

[11] Patent Number: 4,903,574

[45] Date of Patent: Feb. 27, 1990

[54] FIBER SPOOL APPARATUS

[75] Inventors: Richard T. Brown, Manassas; Clint H. Ashton, Warrenton, both of Va.

[73] Assignee: Atlantic Research Corporation, Alexandria, Va.

[21] Appl. No.: 365,363

[22] Filed: Jun. 13, 1989

[51] Int. Cl.[4] ..... D04C 3/16; D04C 3/18; B65H 59/02

[52] U.S. Cl. ..... 87/57; 87/21; 242/156.2

[58] Field of Search ..... 87/20–22, 87/55–57, 33; 242/156, 156.2

[56] References Cited

U.S. PATENT DOCUMENTS

| | | | |
|---|---|---|---|
| 3,038,367 | 6/1962 | Karg et al. | 87/57 X |
| 3,426,804 | 2/1969 | Bluck | 87/33 X |
| 3,757,904 | 9/1973 | Deyoung | 87/57 X |
| 3,817,147 | 6/1974 | Richardson | 87/57 |
| 3,839,939 | 10/1974 | Wily | 87/21 X |
| 3,882,757 | 5/1975 | Weatherby | 87/21 X |
| 4,312,261 | 1/1982 | Florentine | 87/33 |
| 4,529,147 | 7/1985 | Bull et al. | 87/57 X |
| 4,619,180 | 10/1986 | Moyer | 242/156.2 X |
| 4,700,607 | 10/1987 | Heine | 87/57 |
| 4,736,668 | 12/1988 | Moyer | 242/156.2 X |

*Primary Examiner*—John Petrakes
*Attorney, Agent, or Firm*—Frank P. Presta

[57] ABSTRACT

A fiber spool apparatus for a braiding machine or the like, comprising a support, a fiber supply spool rotatably mounted on the support, a housing fixedly mounted on the support and having a plurality of recessed portions on the inner surface thereof, and a coil spring mounted within the housing. The coil spring has an inner end operatively associated with the spool and an outer end in engagement with the inner surface of the housing. When fiber is fed from the spool to the braiding machine, the spool is rotated in a first direction to wind and tension the spring by engagement of the outer end thereof in one of the recessed portions in the housing rotation of the spool in the first direction until the spring reaches a predetermined tension. Continued rotation of the spool in the first direction causes the outer spring end to slip from one recessed portion to another after the spring has reached the predetermined tension. In the event of slack in the fiber being fed to the braiding machine, the tensioned coil spring, by engagement of its outer end in one of the recessed portions of the housing, causes the spool to rotate in the opposite direction to maintain tension in the fiber.

12 Claims, 3 Drawing Sheets

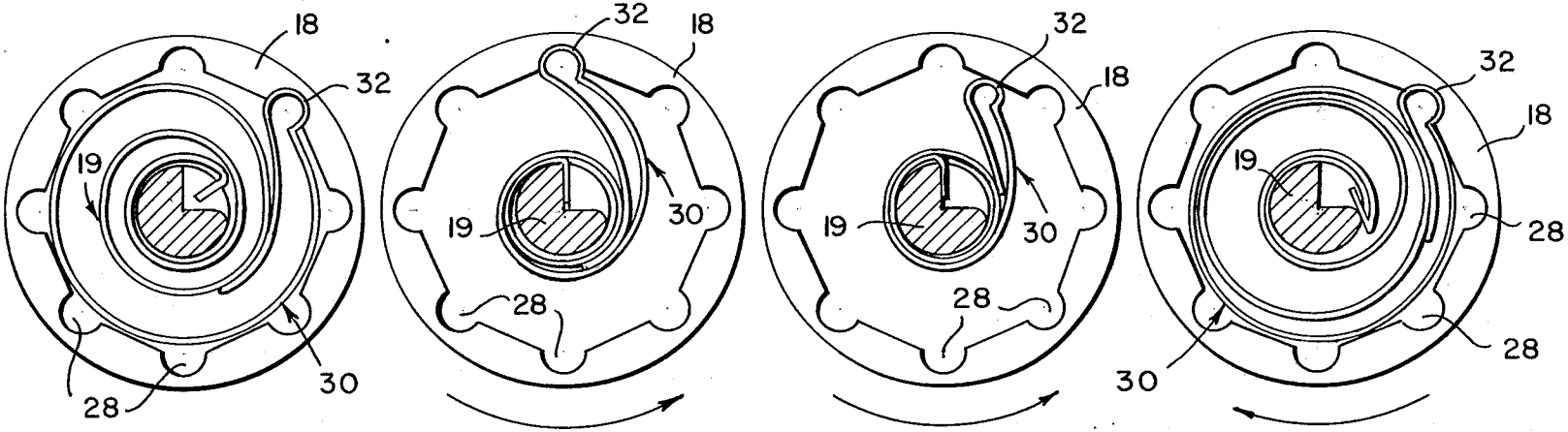
FIG. 7d
FIG. 7c
FIG. 7b
FIG. 7a
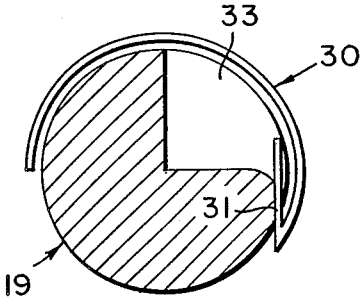
FIG. 8d
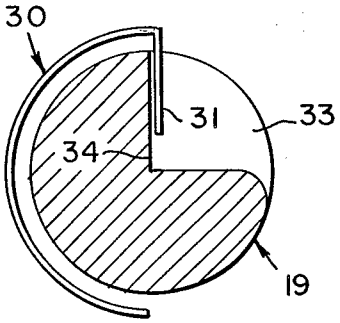
FIG. 8c
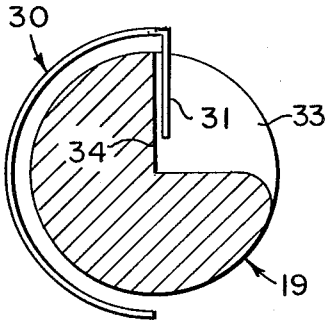
FIG. 8b
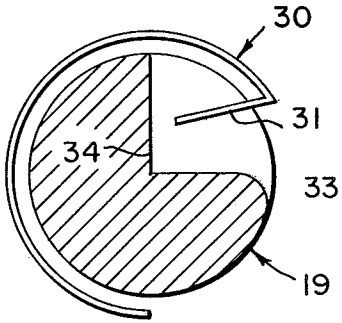
FIG. 8a

FIBER SPOOL APPARATUS

BACKGROUND OF THE INVENTION

The present invention relates to a spool apparatus for feeding a fiber to a braiding machine or the like and, more particularly, to such apparatus wherein a predetermined tension is maintained on the fiber to prevent it from sagging as the spool apparatus traverses the braider bed or the like.

In general, a braiding process is characterized by the fact of all fiber carriers being in motion to result in intertwined fibers. Multi-ply braiding machines use a matrix array of carriers capable of alternate row and column position shifts. Reversal of the direction of row and column motion during a complete shift cycle produces the intertwining of fibers. Production of complex shapes is possible by adjusting the length of travel (number of spaces shifted) of each row or column.

Multi-ply braiding concepts and machines are disclosed in the patent to Bluck, U.S. Pat. No. 3,426,804, and Florentine, U.S. Pat. No. 4,312,261, the teachings of which are incorporated herein by reference. In the Bluck and Florentine patents, each row and column consists of discrete eyelets or carrier blocks. In other machines presently in use, row motion is accomplished by shifting grooved track members containing fiber carriers. Column motion consists of shifting the discrete fiber carriers. Each of the fiber carriers may be provided with a fiber supply spool from which fiber is fed from the carrier to the braiding apparatus. During movement of the fiber carriers, it is important to maintain a predetermined tension on the fiber being fed to the braiding apparatus for the purpose of taking up slack therein and preventing the fiber from sagging, which can result in interference with other fibers and jamming or malfunctioning of the braiding apparatus.

Although there are presently available spool assemblies for such fiber carriers for taking up slack in the fiber as it is fed to a two-ply braiding apparatus or the like, such assemblies have generally been difficult to manufacture in small sizes suitable for fiber carriers in multi-ply braiding machines or the like. Carriers for supply bobbins and braiding machines are disclosed in the patents to Bull et al, U.S. Pat. No. 4,529,147 and Karg et al, U.S. Pat. No. 3,038,367, the teachings of which are incorporated herein by reference. In the Bull patent, the carrier has a raisable circular cap with a vertical extension which controls the tension of the fiber supply. The Karg patent also has tension adjusting properties, but it along with the Bull patent utilizes carriers that are too long vertically, or require an unacceptable large amount of horizontal space.

The fiber spool apparatus disclosed in the patent to Heine, U.S. Pat. No. 4,700,607, is an improvement over those in the Bull et al and Karg et al patents in that it can be produced in a compact size that is useful for a fiber carrier or the like. In the Heine apparatus, however, a tensioning mechanism is utilized that is separate from the supply bobbin for the fiber.

The braider carriers disclosed in the patents to Moyer, U.S. Pat. Nos. 4,619,180 and 4,736,668 are so constructed that they do not require a separate tensioning mechanism. Instead, the tensioning mechanism is built into the supply bobbin and is in the form of a magnetic clutch and a torsion spring, the spring providing slack control of the fiber to be braided and the clutch providing tensioned feed of the fiber as it is wound off the bobbin. The magnetic clutch of Moyer is somewhat complicated in construction, relatively expensive to manufacture and not completely reliable in operation.

Accordingly, a need has arisen for such a fiber spool apparatus that is simple in construction, compact and reliable in operation. The spool apparatus of the present invention fills this need and operates equally well in any desired orientation.

SUMMARY OF THE INVENTION

The fiber spool apparatus of the present invention generally comprises a simple tensioning mechanism that is a part of the supply bobbin or spool assembly. The tensioning mechanism is a simple overwind clutch device having a spring and a motor housing. An interior circumferential surface of the motor housing is provided with a plurality of recess portions substantially equally spaced circumferentially therealong. A coil spring is mounted within the motor housing with its inner end anchored to a rotatable support such as the post or axle on which the supply spool or bobbin is mounted, and its outer end in engagement with the inner circumferential surface of the stationary motor housing. The outer end of the coil spring is bent or curved to a shape that is generally complementary to that of the recess portions in the motor housing interior surface. The inner end of the coil spring is bent in an "L" shape and is disposed in a notch in the axle. The inner end of the spring is held against the axle when in tension and is folded back against the adjacent curved portion or the axle when rewinding.

As the axle and supply spool are rotated to advance fiber to the braiding apparatus, the outer end of the coil spring engages in one of the recess portions of the motor housing to wind the spring to a predetermined tension. Thereafter, further rotation of the axle and supply spool in the same direction will cause the outer end of the coil spring to slip from one recess portion to the next to prevent overwinding of the spring. If any slack develops in the fiber being fed from the supply spool to the braiding apparatus, the outer end of the wound coil spring will engage one of the recess portions of the motor housing to cause the axle and supply spool to rotate in the opposite direction to wind the fiber on the supply spool and maintain a predetermined tension on the fiber.

BRIEF DESCRIPTION OF THE DRAWINGS

FIGS. *7a–d* are enlarged plan view, partly in section, of the axle, coil spring and motor housing of the present invention, showing the coil spring in various stages of operation; and FIGS. 8*a–d* are enlarged plan views of the axle and inner end of the coil spring in various stages of operation corresponding to those shown in FIGS. 7*a–d*, respectively.

DESCRIPTION OF THE PREFERRED EMBODIMENTS

Figure 1:
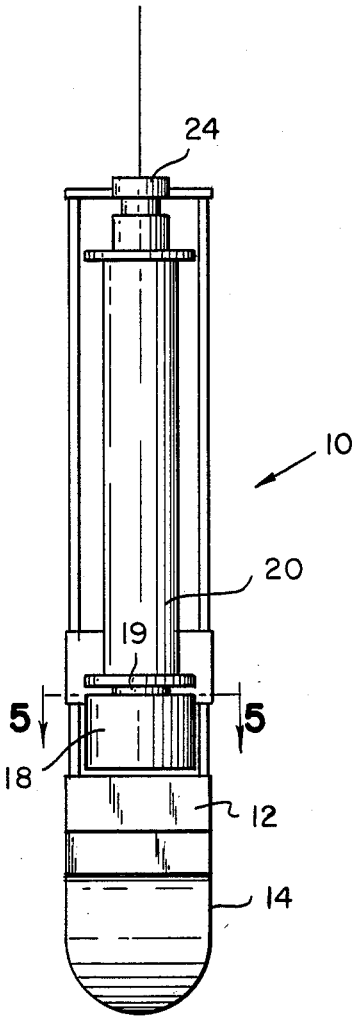
FIG. 1 is a front elevational view of a first embodiment of the fiber spool apparatus of the present invention, with the supply spool or bobbin in a vertical orientation.
Figure 2:
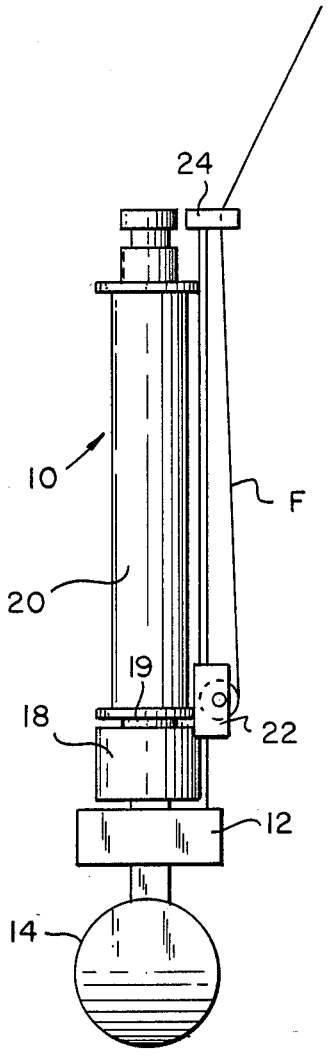
FIG. 2 is a side elevational view of the apparatus shown in FIG. 1.

FIGS. 1 and 2 illustrate the first embodiment of the spool apparatus 10 of the present invention which generally comprises a support frame 12 having slider member 14 on the bottom thereof which is adapted to be mounted in any suitable manner for sliding movement on a braiding apparatus (not shown) or the like. A motor housing 18 of generally cylindrical configuration is fixedly mounted in any suitable manner on the support frame 12 and surrounds an axle member 19 that is rotatably mounted on the support frame 12 and is secured to the lower end of a fiber spool 20. As shown in FIG. 2, the rotational axis of the fiber spool 20 is generally vertically oriented and is generally parallel to the direction of travel of the fiber F from the spool, past a slidable guide member 22 and through the eyelet 24 to the braiding apparatus (not shown).

Figure 5:
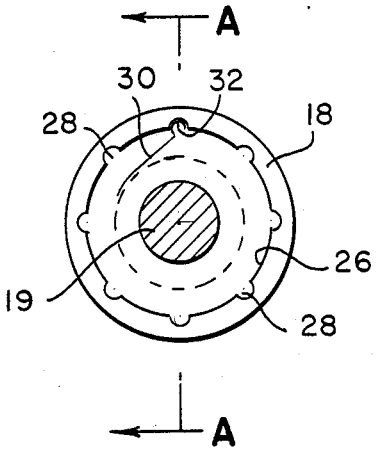
FIG. 5 is a sectional view taken substantially along line 5—5 of FIG. 1.
Figure 6:
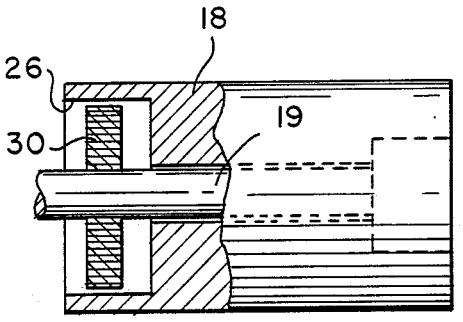
FIG. 6 is a sectional view taken substantially along line 6—6 in FIG. 5.

Referring to FIGS. 5 and 6, the interior surface 26 of the motor housing 18 is provided with a plurality of recessed portions 28 that are substantially evenly spaced circumferentially. A coil spring 30 is disposed between the axle member 19 and the surrounding motor housing 18. The inner end of the coil spring is operatively associated with the axle member 19 in a manner to be more specifically described hereinafter, and the outer end 32 of the coil spring is in engagement with the interior circumferential surface 26 of the motor housing 18. Preferably, the recessed portions 28 in the motor housing 18 are curved in configuration and the outer end 32 of the spring 30 is also curved in a configuration that is complementary to that of the recessed portions 28. As shown in FIGS. 7*a–d*, the outer end 32 of the coil spring 30 is bent back on itself so as to provide the desired curved configuration.

Figure 3:
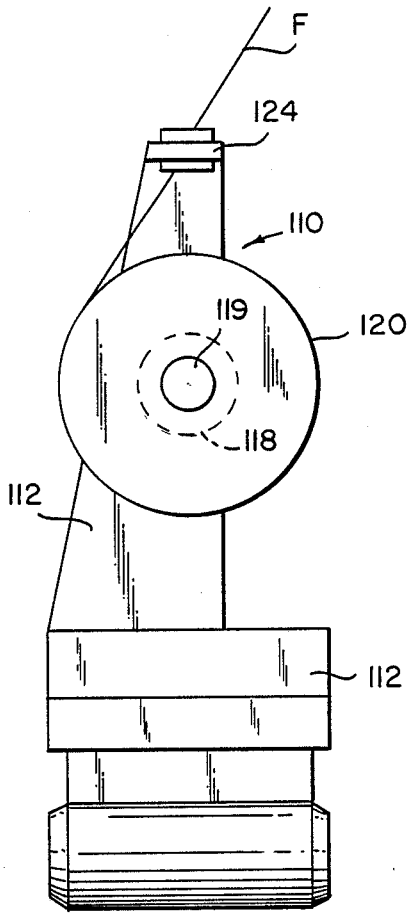
FIG. 3 is a side elevational view of a second embodiment of the apparatus of the present invention, with the supply spool or bobbin in a horizontal orientation.
Figure 4:
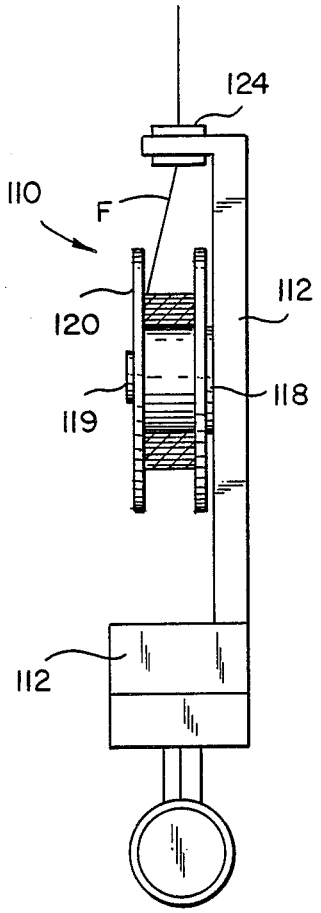
FIG. 4 is a front elevational view of the apparatus shown in FIG. 3.

The second embodiment of the fiber spool apparatus of the present invention shown in FIGS. 3 and 4 is generally similar to that shown in FIGS. 1 and 2 with the exception that the fiber spool 120 and its axle 119 are rotatably mounted on the support frame 118 with the axis of rotation thereof being generally horizontal and perpendicular to the path of travel of the fiber F from the spool 120 through the eyelet 124 and to the braiding apparatus (not shown). Like the apparatus 10 shown in FIGS. 1 and 2, the axle member 119 extends through a motor housing 118 secured to the support frame 112, and a coil spring (not shown) like the spring 30 shown in FIGS. 5–8 is disposed between the axle member 119 and the inner circumferential surface of the motor housing 118 with the inner end of the spring operatively associated with the axle member 119 and the outer end of the spring in engagement with the inner surface of the motor housing 118. The motor housing 118 is constructed like the housing 18 shown in FIGS. 5 and 6 wherein the inner surface thereof is provided with a plurality of evenly spaced recessed portions in which the outer end of the coil spring is adapted to be engaged.

As shown in FIGS. 7*a–d* and 8*a–d*, the inner end of the coil spring 30 is generally L- or V-shaped to provide an inner tab member 31 that is disposed within a notch 33 in the axle member 19. At rest, the tab member 31 extends in to the mid-portion of the notch 33 in the manner shown in FIGS. 7*a* and 8*a*. During winding of the coil spring 30, as shown in FIGS. 7*b,c* and 8*b,c*, the tab member 31 engages a side portion 34 of the notch 33 to anchor the inner end of the spring. During unwinding of the spring 30, the tab member 31 will be bent back against the outer surface of the axle member 19 adjacent the notch 33 in the manner shown in FIGS. 7*d* and 8*d* to facilitate the unwinding of the spring.

Since the operation of the spool apparatus 10 shown in FIGS. 1 and 2 and the spool apparatus 110 shown in FIGS. 3 and 4 is substantially identical, only the operation of the spool apparatus 10 will be described herein after for the purpose of simplification. In the operation of the apparatus 10, as the axle member 19 and supply spool 20 are rotated (in a counterclockwise direction as shown in FIGS. 7*b* and 8*b*) to advance fiber F to the braiding apparatus (not shown), the outer end 32 of the coil spring 30 engages in one of the recessed portions 28 of the motor housing 18 to wind the spring to a predetermined tension. Thereafter, further rotation of the axle member 19 and spool 20 in the same direction will cause the outer end of 32 of the coil spring 30 to slip from one recessed portion 28 to the next (FIGS. 7*c* and 8*c*) to prevent overwinding or breaking of the spring.

If any slack develops in the fiber F being fed from the supply spool 20 to the braiding apparatus, the outer end 32 of the wound coil spring 30 will engage one of the recessed portions 28 of the motor housing 18 to cause the axle member 19 and spool 20 to rotate in the opposite direction (clockwise direction as shown in FIGS. 7*d* and 8*d*) to wind the fiber F on the supply spool 20 and maintain a predetermined tension on the fiber.

It will be readily seen, therefore, that the spool apparatus of the present invention is reliable in operation, simple in construction and inexpensive to manufacture. Also, the present spool apparatus, because of its simple construction, can be made of a small size and the spool can be oriented in any desired orientation, depending on space requirements. The various parts of the subject spool apparatus can be made of any suitable materials.

What is claimed is:

1. A fiber spool apparatus for a braiding machine or the like comprising:

support means;

fiber supply spool means rotatably mounted on said support means;

housing means fixedly mounted on said support means and having a plurality of recessed portions on the inner surface thereof; and coil spring means disposed within said housing means and having an inner end operatively associated with spool means and an outer end in engagement with the inner surface of said housing means;

whereby rotation of said spool means in a first direction to feed fiber to said braiding apparatus causes said coil spring means to be wound and tensioned by engagement of the outer end thereof in one of said recessed portions until said coil spring means reaches a predetermined tension, continued rotation of said spool means in said first direction causes the outer end of said coil spring means to slip from one recessed portion to another after said coil spring means reaches said predetermined tension, and said tensioned coil spring causes said spool means to rotate in the opposite direction in the event of slack in said fiber extending from said spool means to said braiding apparatus to maintain tension in said fiber.

2. The spool apparatus of claim 1 wherein said fiber supply spool means comprises axle means rotatably mounted on said support means, and a fiber spool secured to said axle means, said housing means surrounding a portion of said axle means, and the inner end of said coil spring being operatively associated with said portion of said axle means.

3. The spool apparatus of claim 2 wherein said housing means is generally cylindrical and said recessed portions are substantially equally spaced circumferentially on said inner surface thereof.

4. The spool apparatus of claim 3 wherein said recessed portions and the outer end of said coil spring are substantially complementary in shape.

5. The spool apparatus of claim 4 wherein said recessed portions and the outer end of said coil springs are generally curved in shape;.

6. The spool apparatus of claim 2 wherein said axle means has a notch therein, and the inner end of said coil spring comprises a tab member that is disposed in said notch.

7. The spool apparatus of claim 6 wherein said tab member extends to an angle to the adjacent portion of said spring, whereby during tensioning of said spring said tab member engages one side of said notch to anchor the inner end of said spring.

8. The spool apparatus of claim 7 wherein said tab member is oriented to be bent back against the adjacent surface of said axle means during rotation of said axle means and spool in said opposite direction to facilitate unwinding of said spring.

9. The spool apparatus of claim 1 wherein the axis of rotation of said spool means is generally parallel to the direction of feed of the fiber from said spool means to the braiding apparatus.

10. The spool apparatus of claim 9 wherein said housing means is disposed near one end of said spool means.

11. The spool apparatus of claim 1 wherein the axis of rotation of said spool means is generally perpendicular to the direction of feed of the fiber from said spool means to the braiding apparatus.

12. The spool apparatus of claim 11 wherein said housing means is disposed near the midportion of said spool means.

* * * * *